US005366145A

United States Patent [19]

Sauerwine

[11] Patent Number: 5,366,145

[45] Date of Patent: Nov. 22, 1994

[54] SINGLE PLY ECCENTRIC C-FOLD

[75] Inventor: Dean N. Sauerwine, Emmaus, Pa.

[73] Assignee: Moore Business Forms, Inc., Grand Island, N.Y.

[21] Appl. No.: 43,299

[22] Filed: Apr. 6, 1993

[51] Int. Cl.[5] ..... B65D 27/04; B65D 27/06

[52] U.S. Cl. ..... 229/304; 229/92.3; 229/314

[58] Field of Search ..... 229/305, 304, 314, 92.1, 229/92.3

[56] References Cited

U.S. PATENT DOCUMENTS

| | | | |
|---|---|---|---|
| 1,957,704 | 5/1934 | Drachman | 229/305 |
| 2,681,175 | 6/1954 | David | 229/304 |
| 2,759,658 | 8/1956 | Sawdon | 229/305 |
| 2,910,222 | 10/1959 | Bermingham, Jr. et al. | 229/303 |
| 3,171,583 | 3/1965 | Klein | 229/316 |
| 3,718,277 | 2/1973 | Volkert | 229/92.1 |
| 3,726,471 | 4/1973 | Kalb | 229/303 |
| 3,858,792 | 1/1975 | Volkert | 229/92.1 |
| 4,896,823 | 1/1990 | Taylor | 229/303 |
| 4,899,926 | 2/1990 | Spaulding | 229/304 |
| 4,915,287 | 4/1990 | Volk et al. | 229/301 |
| 5,064,115 | 11/1991 | Steidinger | 229/304 |
| 5,110,043 | 5/1992 | Ashby | 229/304 |
| 5,133,496 | 7/1992 | Davidson et al. | 229/313 |
| 5,193,850 | 3/1993 | Lombardo . | |
| 5,201,464 | 4/1993 | File . | |

*Primary Examiner*—Stephen P. Garbe
*Attorney, Agent, or Firm*—Nixon & Vanderhye

[57] ABSTRACT

An intermediate and mailer are provided, the mailer formed by concentrically C-folding a single sheet of paper. The narrow portion of the mailer is the front of the reply envelope, and a statement, coupon, etc., adapted to be placed into the return envelope, is connected to the return envelope by a perforation line when the mailer is opened. A vertical perforation separates the mailer into two parts, one part comprising the return envelope and statement or coupon when opened, and the other part being a six-part booklet, and including the outgoing address information which typically is visible through a window in the mailer front face. To facilitate opening, where a horizontal perf is to be torn the mailer has only a double thickness instead of a triple thickness.

22 Claims, 3 Drawing Sheets

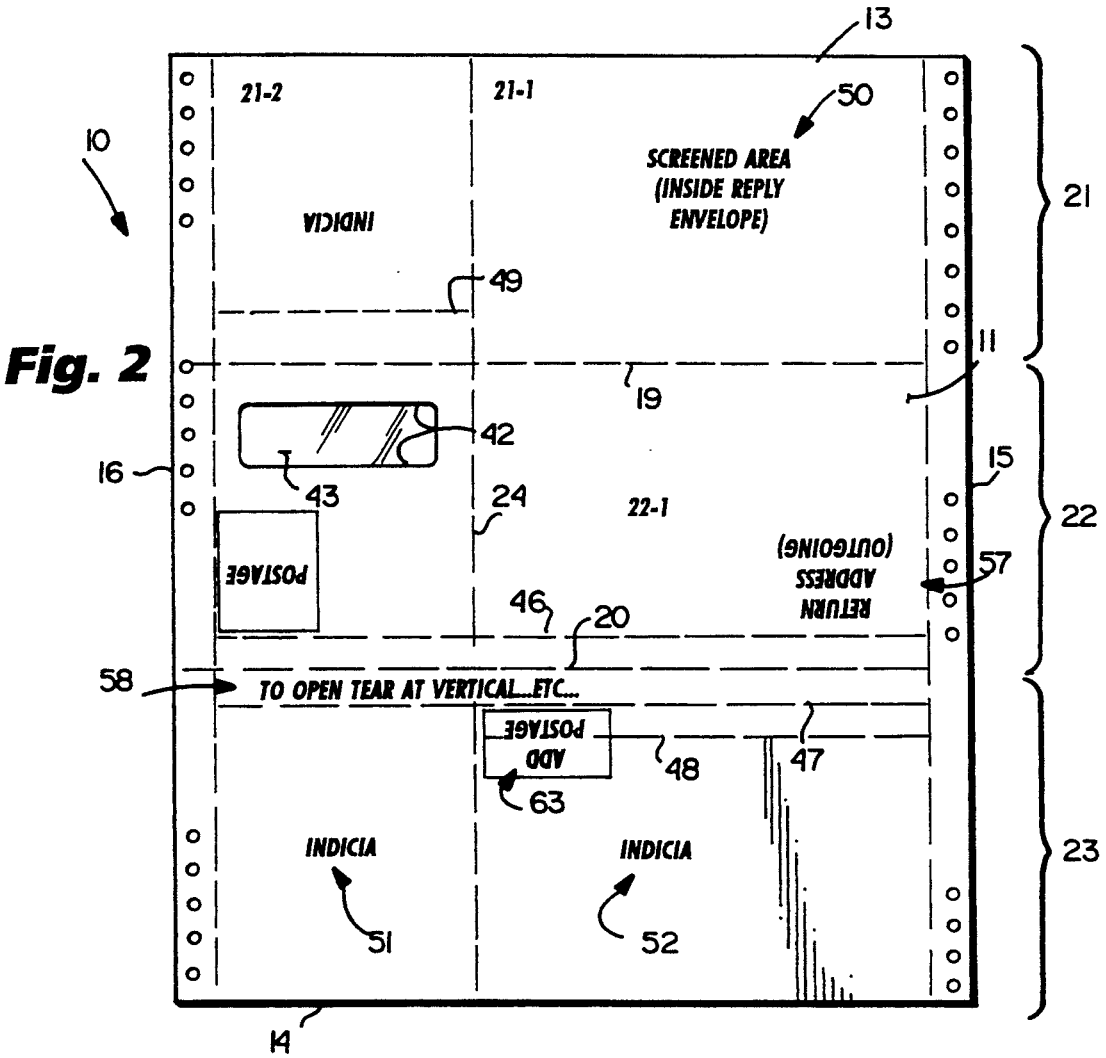
Fig. 2
Fig. 4
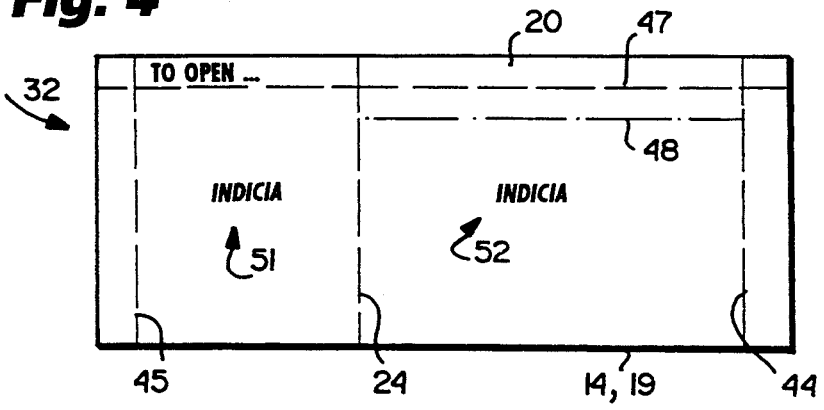

Fig. 5
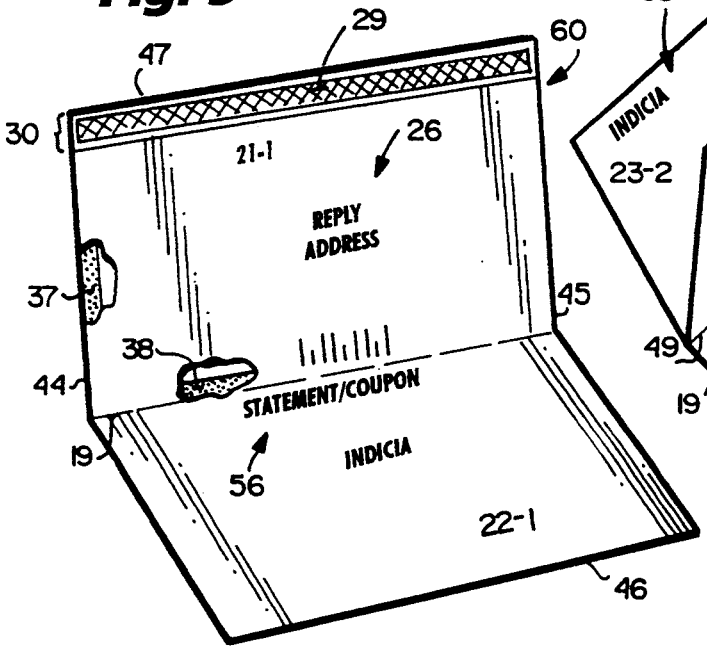
Fig. 7
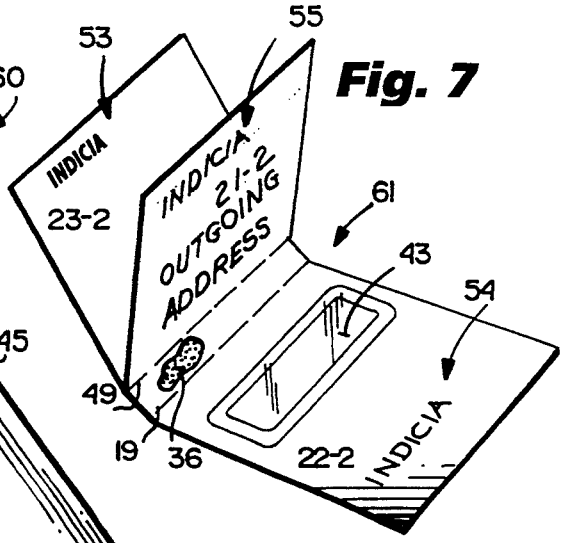
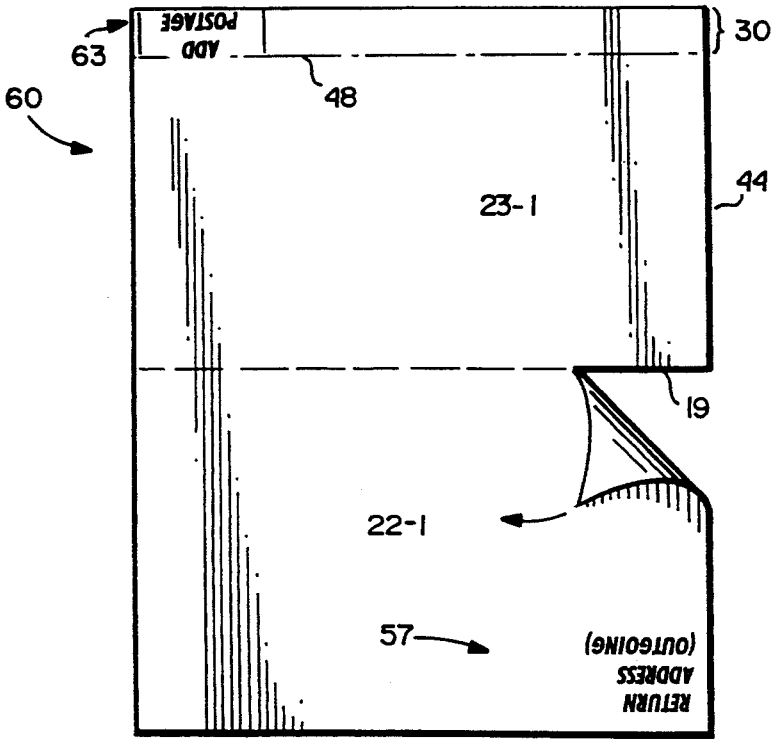
Fig. 6

SINGLE PLY ECCENTRIC C-FOLD

BACKGROUND AND SUMMARY OF THE INVENTION

It is desirable to construct mailer type business forms so that they may be made as simply as possible, yet at the same time contain as much information as possible. It is also highly desirable to have a reply envelope with many mailers. All of these desideratum are accomplished according to the invention by providing an intermediate, and then a final mailer, that is formed by eccentrically C-folding a single sheet of paper.

The mailer according to the invention is particularly advantageous because the components thereof, especially forming the return envelope portion, are disposed so that to open the mailer along the longitudinal dimension thereof, one needs only to detach at a perforation where the mailer is only two plies thick instead of three plies thick. Thus, the mailer is easy to open. As soon as the mailer is opened, the reply envelope is readily accessible, and the reply envelope is formed with a statement or coupon portion connected along one edge thereof by a perforation. Thus, one has the coupon or statement that is desirably returned in the reply envelope connected to the envelope so that it cannot get lost.

Also, according to the invention, one opens the mailer along a central vertical perforation in addition to the longitudinal perforation, the vertical perforation dividing the mailer into two parts, one part comprising the return envelope with attached statement or coupon, and the other forming a "booklet" having six parts (faces), with pages of the booklet detachable from each other. The mailer has a maximum amount of area that can be imaged with indicia that is useful, or the "booklet" part can be a coupon book or the like.

According to one aspect of the present invention, an intermediate for a mailer type business form is provided from a single sheet of paper having front and back faces, parallel top and bottom edges, and first and second parallel side edges. The intermediate comprises: First and second lines of weakness extending parallel to the top and bottom edges, and defining the sheet into first, second, and third panels, the first and second lines of weakness being positioned so that the first panel is bordered by the top edge and the first line of weakness, and is smaller than the second and third panels, which are substantially identical in size, the second panel between the first and third panels. A third line of weakness extending between the top and bottom edges parallel to the side edges and spaced a substantial distance from the side edges to define each of the panels into first and second sub-panels, the first sub-panel of each being defined by the first side edge, and the second sub-panel of each being defined by the second side edge. The first sub-panel of the first panel back face comprises reply addressee indicia imaged thereon. The first sub-panel of the third panel back face having a first non-heat seal adhesive pattern disposed thereon generally parallel to the top edge, and adjacent the second line of weakness. And, second adhesive pattern means disposed adjacent the first and second side edges, and the bottom edge, for sealing the panels together when folded into a mailer about the first and second lines of weakness.

The outgoing addressee indicia is preferably imaged on the back face of the second sub-panel of the first panel spaced a first predetermined distance from the first line of weakness, and a cutout is formed in the second sub-panel of the second panel also spaced substantially the first predetermined distance from the first line of weakness, so that when the sheet is folded into a mailer about the first and second lines of weakness, the outgoing addressee indicia is visible through the cutout.

The intermediate also comprises third and fourth adhesive patterns disposed on the back face of the first sub-panel of the third panel generally parallel to the side edges, the third adhesive pattern being adjacent but spaced from the first side edge, and the fourth adhesive pattern adjacent the third line of weakness, the third and fourth adhesive patterns cooperating with the first sub-panel front face to form a reply envelope when the sheet is folded about the first and second lines of weakness. The second adhesive pattern means preferably comprises a fifth strip of adhesive extending between the third and fourth adhesive patterns on the back face of the first sub-panel of the third panel, with a continuation thereof extending on the back face of the second sub-panel of the third panel, and sixth and seventh strips of adhesive extending on the back face of the second and third panels adjacent the first and second side edges, respectively, substantially the entire length of the second and third panel. The second adhesive pattern means and the third and fourth adhesive patterns may be heat seal, permanent adhesive, or pressure activated adhesive such as used with the "SpeediSealer ®" sealing device sold by Moore Business Forms, Inc., of Lake Forest, Ill. The first adhesive pattern may be rewettable adhesive, or pressure sensitive adhesive covered by a strip of release paper. Security screen indicia may be imaged on the back face of the first sub-panel of the third panel.

The intermediate may also comprise fourth and fifth lines of weakness formed in the second or third panels, respectively, parallel to, adjacent, equi-distant from and straddling the second line of weakness. The fifth line of weakness is immediately adjacent the first adhesive pattern and closer to the second line of weakness than the first adhesive pattern. The fourth and fifth lines of weakness are closer to the second line of weakness than the top edge when the first panel is folded about the first line of weakness. Outgoing addressee indicia is imaged on the front face of the second panel, adjacent, but spaced from, the second line of weakness, and outgoing return addressee indicia is imaged on the front face of the second panel adjacent the fourth line of weakness, and spaced further from the second line of weakness and the fourth line of weakness is spaced from the second line of weakness.

According to another aspect of the present invention, a mailer type business form is provided. The mailer comprises the following elements: First, second, and third plies, the first ply sandwiched between the second and third plies. The second and third plies both having a first width and first length, and the first ply having the first length but a second width, less than the first width; and each of the plies having top and bottom faces, and plies first and second side edges. The first ply has reply address indicia imaged on the top face thereof. Permanent adhesive means are disposed between the third ply top face and the first ply bottom face for forming a return envelope including a flap, the flap being formed by the third ply and extending with respect to the first ply so that no portion of the first ply overlaps the flap. Addressee-activatable adhesive is disposed on the flap top face. Aligned first and second lines of weakness are formed in the second and third plies respectively adjacent the flap, at a point wherein no portion of the first ply overlaps the lines of weakness; and a third line of weakness connects an edge of the second ply opposite the first line of weakness with an edge of the third ply. And, indicia is imaged on the bottom face of the second ply, the bottom face of the second ply in face-to-face engagement with the top face of the first ply.

The mailer may also include outgoing return addressee indicia imaged on the top face of the second ply adjacent the first line of weakness, and postage placement indicating indicia imaged on the bottom face of the third ply flat portion.

The permanent adhesive means for forming the reply envelope may comprise: A first strip of adhesive spaced a substantial distance from the first and second side edges and parallel thereto, and a second strip of adhesive adjacent, but somewhat spaced from, the first edge. It may further comprise a third strip of adhesive adjacent the second edge holding the top face of the first ply in contact with the bottom face of the second ply, a fourth strip of adhesive adjacent the second edge holding the bottom face of the first ply in contact with the rod face of the second ply, a fifth strip of adhesive closer to the first edge than the second strip for holding the top face of the first ply in contact with the bottom face of the second ply, and a sixth strip of adhesive closer to the first edge than the second strip for holding the bottom face of the first ply in contact with the top face of the second ply. Third, fourth and fifth aligned lines of weakness may also be formed in the first, second and third plies, respectively, extending parallel to the side edges, adjacent the first strip of adhesive, but closer to the second edge than the first strip of adhesive. A seventh strip of adhesive is disposed between the fifth line of weakness and the second edge for holding the bottom face of the first ply in contact with the top face of the third ply. Also, a sixth line of weakness may be formed in the first ply and extend between the third line of weakness and the second edge immediately adjacent the seventh strip of adhesive. A cutout and outgoing addressee indicia may be provided in the second and on the first plies, respectively, as described above with respect to the intermediate. Also, there may be sixth through eighth and ninth through eleventh lines of weakness extending parallel to and adjacent the first and second edges, respectively, in the first, second and third plies, respectively, for allowing ready detachment of the third through sixth strips of adhesive from the rest of the plies, to facilitate opening of the mailer.

The invention also comprises a method of opening a multi-ply mailer having a built-in return envelope, and having top, bottom and first and second side edges. The mailer has a first line of weakness extending through all plies between the top and bottom thereof spaced a substantial distance from both the first and second edges, and a second line of weakness extends between less than all plies, immediately adjacent and parallel to the top. Outgoing addressee indicia is visible from the outside of the mailer, the outgoing addressee indicia being right-side up when the top of the mailer is above the bottom. The method comprises the steps of: (a) Tearing the mailer along the first line of weakness to separate it into two components, one component including a return envelope, and to gain access to the second line of weakness. Then, (b) tearing each of the two components along the second line of weakness to gain access to the interior of the two components, including the return envelope. The mailer also preferably comprises third and fourth lines of weakness extending parallel to the first line of weakness through all plies of the mailer adjacent the first and second side edges, respectively. There is a further step (c) of, prior to step (b), tearing the mailer at the third and fourth line of weakness.

It is a primary object of the present invention to provide a versatile, easy open, mailer that may be formed by eccentrically C-folding a single sheet of paper, and an intermediate and method of opening associated therewith. This and other objects of the invention will become clear from an inspection of the detailed description of the invention and from the appended claims.

BRIEF DESCRIPTION OF THE DRAWINGS

FIG. 2 is a top plan view of the front face of the intermediate of FIG. 1;

FIG. 4 is a back view of the mailer that is constructed according to the invention;

FIG. 5 is a top perspective view showing the return envelope and attached coupon after the mailer of FIGS. 3 and 4 has been opened;

FIG. 6 is a rear view of the reply envelope and attached statement or coupon of FIG. 5, showing the statement or coupon being detached; and FIG. 7 is a top perspective view of a "booklet" formed from the right-hand portion of the mailer of FIG. 3 after it has been opened.

DETAILED DESCRIPTION OF THE DRAWINGS

Figure 1:
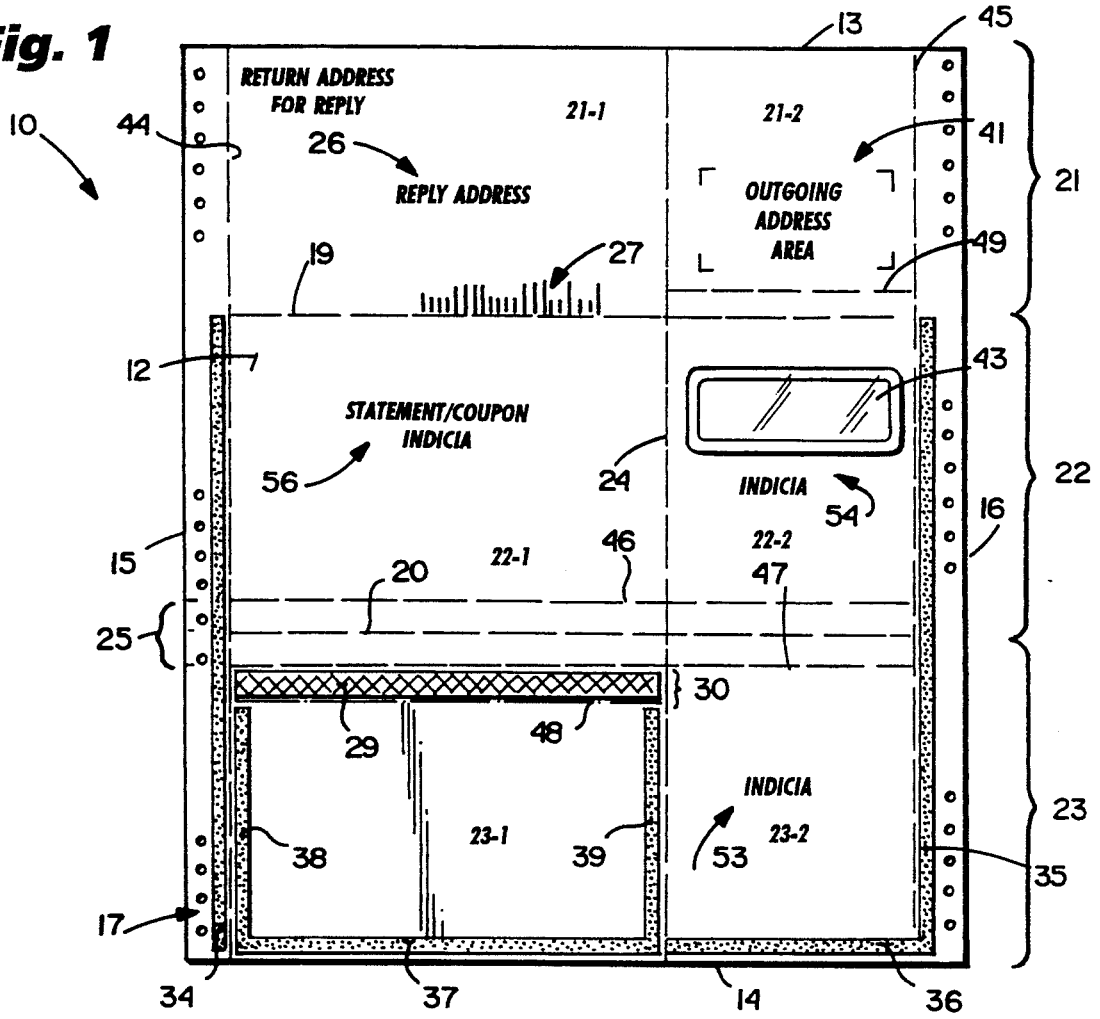
FIG. 1 is a top plan view of the back face as an intermediate according to the invention.

An intermediate according to the present invention is shown generally by reference numeral 10 in FIGS. 1 and 2. The intermediate comprises a single sheet of paper having a front face 11 (FIG. 2) and a back face 12 (FIG. 1). It also includes parallel top and bottom edges 13, 14, respectively, and first and second parallel side edges 15, 16. Detachable edge portions 17 which may have tractor feed openings therein are also provided—preferably they are slit off after printing (compare FIGS. 1 and 3).

The intermediate 10 also comprises first and second lines of weakness 19, 20, extending parallel to the top and bottom edges 13, 14, and defining the intermediate into first, second and third panels 21, 22, 23, respectively. The first panel 21 is between the top edge 13 and the first line of weakness 19, the third panel 23 is between the bottom edge 14 and the second line of weakness 20, and the second panel 22 is between the first and third panels 21, 23. The lines of weakness 19, 20 may be perforations, deep score lines, or the like.

A third line of weakness 24 is also provided, which extends parallel to the side edges 15, 16 and is substantially spaced from both of them. The third line of weakness 24 divides each panel 21–23 into first and second sub-panels, e.g., sub-panels 21-1 and 21-2, 22-1 and 22-2, and 23-1 and 23-2.

Note that while the panels 22, 23 have approximately identical dimensions, the panel 21 has a much narrower "width" typically being narrower by an amount equal to half of the dimension 25 illustrated in FIG. 1.

Sub-panel 21-1 comprises reply address indicia imaged thereon, typically both human readable indicia 26 and machine readable (e.g., bar code) indicia 27, on the back face 12 thereof (see FIG. 1). Sub-panel 23-1 has first non-heat seal adhesive pattern 29 disposed thereon generally parallel to the top edge 13 and adjacent the fourth line of weakness 47 (or spaced from it) actually on a flap portion 30 of what will be the return envelope. Preferably, the adhesive 29 is rewettable adhesive, or it can be pressure-sensitive adhesive covered by a release strip.

The intermediate 10 also comprises second adhesive pattern disposed adjacent the side edges 15, 16 and the bottom edge 14 for sealing the panels 21 through 23 together when folded into a mailer 32 (see FIGS. 3 and 4) about the lines of weakness 19, 20. A second adhesive pattern means preferably comprises strips of heat sealable, or pressure activated adhesive (such as utilized with a SpeediSealer ® device sold by Moore Business Forms, Inc., of Lake Forest, Ill.) 34, 35 adjacent the side edges 15, 16, with the bottom including the strip 36, and also the strip 37 which in addition to sealing the sheets 11 into the mailer 32 forms a reply envelope. The strips 38, 39 on the back face 12 of the sub-panel 23-1 engage the front face 11 of the sub-panel 21-1 to form the reply envelope, the strips 37–39 also preferably being heat sealable permanent adhesive or the like.

Figure 3:
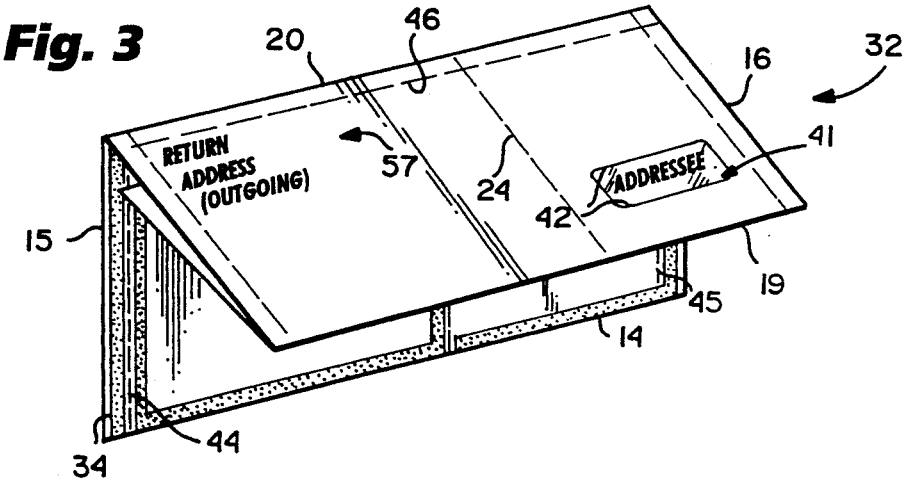
FIG. 3 is a top perspective view showing the intermediate of FIGS. 1 and 2 being folded into a mailer.

While the outgoing address information for the mailer 32 constructed from the intermediate 10 may take a wide variety of forms, one particularly desirable form (where all variable information may be simplex printed) is seen most clearly in FIGS. 1 and 3, in which outgoing addressee indicia 41 is imaged on the sub-panel 21-2 back face 12 in a position such that it will be overlain by a cutout 42 (see FIGS. 2 and 3, which cutout 42 may be covered by a transparent—e.g., glassine—patch 43—see FIG. 1) when the intermediate 10 is folded about the line 19.

The intermediate 10 also preferably has additional lines of weakness. For example, there are the lines of weakness 44, 45 which are provided adjacent and parallel to the side edges 15, 16, but on the opposite sides of the adhesive strips 34, 35 from the side edges 15, 16, respectively. These lines of weakness (e.g., perforations) in the final mailer (e.g., see FIG. 4) allow detachment of the adhesive strips 34, 35 to facilitate opening of the mailer 32. The lines of weakness 46, 47 extend parallel to the top and bottom edges 13, 14, straddling and equi-distant from the second line of weakness 20. In the mailer configuration 32 of FIGS. 3 and 4, since the first panel 21 has no component at the area of these lines of weakness (e.g., perforations) 46, 47, easy opening is provided because the mailer 32 has only double thickness there.

Flap 30 may also be defined by a fold line or line of weakness 48, and another line of weakness 49 may be provided in the sub-panel 21-2 just below the outgoing addressee indicia 41. Security indicia, that is typically a "screened" area, may be provided on the face 11 of the sub-panel 21, as indicated by the writing 50 in FIG. 2, to make the return envelope opaque, or at least non-transparent, and additional indicia may be printed everywhere else on the form, the intermediate 10 having a wide variety of places for indicia such as indicated by reference numerals 51 through 55 in FIGS. 1, 2, 4 and 7, as well as the statement or coupon indicia 56 provided on the back face 12 of sub-panel 22-1. Further, return addressee (for the outgoing mailer 32) indicia 57 is imaged on the front face 11 of the sub-panel 22-1 so that there is more room for statement or coupon information 56 on the face 12 of sub-panel 22-1 (the name of the sender of the mailer 32 not necessary on the face 12 since it (57) appears on the face 11 of sub-panel 22-1 forming completed mailer 32).

Once the mailer 32 is received by the outgoing addressee (as indicated by indicia 41) it is opened according to the instructions provided by indicia 58. These instructions suggest opening by first tearing along the "vertical" lines 44 24, 45, and then along the "horizontal" perforations lines 46, 47 (the form having only double thickness at the lines 46, 47). This completely opens the mailer 32, to expose reply envelope 60 and attached but detachable statement or coupon sub-panel 22-1, and a six-part (face) "booklet" 61 (see FIG. 7). Sub-panels 21-1 and 23-1 are held together by the glue strips 37 through 39, and to use the reply envelope 60 one merely tears the statement or coupon formed by the sub-panel 22-1 at the perforation line 19 (as illustrated in FIG. 6), sticks a check and the sub-panel 22-1, and/or any other desired information or elements, into the reply envelope 60, folds the flap 30 about the line 48 after wetting the rewettable adhesive strip 29, and then seals the strip 29 in place, the reply address 26 then being readily visible.

Indicia 63 also may be provided on the front face 11 of the sub-panel 23-1 (see FIGS. 2 and 6), that is the portion of the flap 30 opposite the adhesive strip 29, indicating that postage should be added and visible when the flap 30 is pivoted about the fold line 48 to seal the reply envelope 60.

The booklet 61 has six different faces (parts) which each can have indicia thereon, or at least some will have indicia thereon, and, for example, may form a coupon book or the like. The adhesive strip 36 holds the sub-panels 21-2, 23-2 together, but the sub-panel 21-2 may be detached by tearing along the perforation line 49.

It will thus be seen that according to the present invention an advantageous intermediate which can construct a versatile mailer having a readily accessible reply envelope, with a great deal of space for indicia, and a method of opening of the mailer, have been provided. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and processes.

What is claimed is:

1. An intermediate for a mailer type business form comprising a single sheet of paper having front and back faces, parallel top and bottom edges, and first and second parallel side edges;

first and second lines of weakness extending parallel to said top and bottom edges, and defining the sheet into first, second, and third panels, said first and second lines of weakness being positioned so that said first panel is bordered by said top edge and said first line of weakness, and is smaller than said second and third panels, which are substantially identical in size, said second panel between said first and third panels;

a third line of weakness extending between said top and bottom edges parallel to said side edges and spaced a substantial distance from said side edges to define each of said panels into first and second sub-panels, said first sub-panel of each being defined by said first side edge, and said second sub-panel of each being defined by said second side edge;

said first sub-panel of said first panel back face comprising reply addressee indicia imaged thereon;

said first sub-panel of said third panel back face having a first non-heat seal adhesive pattern disposed thereon generally parallel to said top edge, and adjacent said second line of weakness; and a second adhesive pattern disposed adjacent said first and second side edges, and said bottom edge, for sealing said panels together when folded into a mailer about said first and second lines of weakness.

2. An intermediate as recited in claim 1 further comprising outgoing addressee indicia imaged on said back face of second sub-panel of said first panel spaced a first predetermined distance from said first line of weakness; and a cutout formed in said second sub-panel of said second panel and also spaced substantially said first predetermined distance from said first line of weakness, so that when said sheet is folded into a mailer about said first and second lines of weakness, said outgoing addressee indicia is visible through said cutout.

3. An intermediate as recited in claim 2 further comprising third and fourth adhesive patterns disposed on said back face of said first sub-panel of said third panel generally parallel to said side edges, said third adhesive pattern being adjacent but spaced from said first side edge, and said fourth adhesive pattern adjacent said third line of weakness, said third and fourth adhesive patterns cooperating with said first panel first sub-panel front face to form a reply envelope when said sheet is folded about said first and second lines of weakness.

4. An intermediate as recited in claim 1 further comprising third and fourth adhesive patterns disposed on said back face of said first sub-panel of said third panel generally parallel to said side edges, said third adhesive pattern being adjacent but spaced from said first side edge, and said fourth adhesive pattern adjacent said third line of weakness, said third and fourth adhesive patterns cooperating with said first panel first sub-panel front face to form a reply envelope when said sheet is folded about said first and second lines of weakness.

5. An intermediate as recited in claim 4 wherein said second adhesive pattern comprises a fifth strip of adhesive extending between said third and fourth adhesive patterns on said back face of said first sub-panel of said third panel, with a continuation thereof extending on said back face of said second sub-panel of said third panel, and sixth and seventh strips of adhesive extending on said back face of said second and third panels adjacent said first and second side edges, respectively, substantially the entire length of said second and third panels.

6. An intermediate as recited in claim 5 wherein said second adhesive pattern means and said third and fourth adhesive patterns are selected from the group consisting essentially of heat seal and pressure activated adhesive; and wherein said first adhesive pattern is selected from the group consisting essentially of rewettable adhesive and pressure sensitive adhesive covered by a strip of release paper.

7. An intermediate as recited in claim 5 further comprising security screening indicia imaged on said back face of said first sub-panel of said third panel.

8. An intermediate as recited in claim 1 further comprising fourth and fifth lines of weakness formed in said second and third panels, respectively, parallel to, adjacent, equi-distant from, and straddling said second line of weakness, said fifth line of weakness immediately adjacent said first adhesive pattern and closer to said second line of weakness than said first adhesive pattern; and said fourth and fifth lines of weakness being closer to said second line of weakness than said top edge when said first panel is folded about said first line of weakness.

9. An intermediate as recited in claim 8 further comprising outgoing return addressee indicia imaged on said front face of said second panel adjacent said fourth line of weakness, and spaced further from said second line of weakness than said fourth line of weakness is spaced from said second line of weakness.

10. An intermediate as recited in claim 1 further comprising outgoing return addressee indicia imaged on said front face of said second panel adjacent, but spaced from, said second line of weakness.

11. A mailer type business form comprising:

first, second, and third plies, said first ply sandwiched between said second and third plies; said second and third plies both having a first width and first length, and said first ply having said first length but a second width, less than said first width; and each of said plies having top and bottom faces, and said plies having first and second side edges;

said first ply having reply address indicia imaged on said top face thereof;

a permanent adhesive disposed between said third ply top face and said first ply bottom face for forming a return envelope including a flap, said flap being formed by said third ply and extending with respect to said first ply so that no portion of said first ply overlaps said flap;

addressee-activatable adhesive disposed on said flap top face;

aligned first and second lines of weakness formed in said second and third plies respectively adjacent said flap, at a point wherein no portion of said first ply overlaps said lines of weakness; and a third line of weakness connecting an edge of said second ply opposite said first line of weakness with an edge of said first ply; and indicia imaged on said bottom face of said second ply, said bottom face of said second ply in face-to-face engagement with said top face of said first ply.

12. A mailer as recited in claim 11 further comprising outgoing return address indicia imaged on said top face of said second ply adjacent said first line of weakness.

13. A mailer as recited in claim 12 further comprising postage placement indicating indicia imaged on said bottom face of said third ply flap portion.

14. A mailer as recited in claim 11 wherein said permanent adhesive means for forming said reply envelope comprises a first strip of adhesive spaced a substantial distance from said first and second side edges, and parallel thereto, and a second strip of adhesive adjacent, but somewhat spaced from, said first edge; and further comprising a third strip of adhesive adjacent said second edge holding said top face of said first ply in contact with said bottom face of said second ply, a fourth strip of adhesive adjacent said second edge holding said bottom face of said first ply in contact with said top face of said second ply, a fifth strip of adhesive closer to said first edge than said second strip for holding said top face of said first ply in contact with said bottom face of said second ply, and a sixth strip of adhesive closer to said first edge than said second strip for holding said bottom face of said first ply in contact with said top face of said second ply.

15. A mailer as recited in claim 14 further comprising third, fourth, and fifth aligned lines of weakness formed in said first, second, and third plies, respectively, extending parallel to said side edges, adjacent said first strip of adhesive, but closer to said second edge than said first strip of adhesive.

16. A mailer as recited in claim 15 further comprising a seventh strip of adhesive extending between said fifth line of weakness and said second edge for holding said bottom face of said first ply in contact with said top face of said third ply.

17. A mailer as recited in claim 16 further comprising a sixth line of weakness formed in said first ply and extending between said third line of weakness and said second edge immediately adjacent said seventh strip of adhesive.

18. A mailer as recited in claim 14 further comprising a cutout in said second ply between said fourth line of weakness and said second edge, and outgoing address indicia imaged on said top face of said first ply underlying said cutout so that said outgoing address indicia is visible through said cutout.

19. A mailer as recited in claim 18 further comprising additional indicia imaged on said top face of said first ply between said third line of weakness and second edge, on said bottom face of said second ply between said fourth line of weakness and second edge, and on said top face of said third ply between said fifth line of weakness and said second edge.

20. A mailer as recited in claim 14 further comprising sixth through eighth and ninth through eleventh lines of weakness extending parallel to and adjacent said first and second edges, respectively, in said first, second and third plies, respectively, for allowing ready detachment of said third through sixth strips of adhesive from the rest of said plies, to facilitate opening of said mailer.

21. A method of opening a multi-ply mailer having a built-in return envelope and having top, bottom, and first and second side edges, with a first line of weakness extending through all plies between the top and bottom thereof spaced a substantial distance from both the first and second edges, and a second line of weakness extending between less than all plies immediately adjacent and parallel to the top, outgoing addressee indicia being visible from the outside of the mailer, the outgoing addressee indicia being right-side up when the top of the mailer is above the bottom, said method comprising the steps of:

(a) tearing the mailer along the first line of weakness to separate it into two components, one component including a return envelope, and to gain access to the second line of weakness; then (b) tearing each of the two components along the second line of weakness to gain access to the interior of the two components, including the return envelope.

22. A method as recited in claim 21 wherein the mailer also comprises third and fourth lines of weakness extending parallel to the first line of weakness through all plies of the mailer adjacent the first and second edges thereof, respectively; and comprising the further step (c) of, prior to step (b), tearing the mailer at the third and fourth lines of weakness.

* * * * *